US005651443A

United States Patent [19]

Gaudette

[11] Patent Number: 5,651,443

[45] Date of Patent: Jul. 29, 1997

[54] ELECTRICAL NOISE SUPPRESSION IN COIN ACCEPTOR MECHANISM

[75] Inventor: Marvin F. Gaudette, Rockton, Ill.

[73] Assignee: Eaton Corporation, Cleveland, Ohio

[21] Appl. No.: 584,592

[22] Filed: Jan. 11, 1996

[51] Int. Cl.[6] ..... G07F 3/00

[52] U.S. Cl. ..... 194/203; 194/244

[58] Field of Search ..... 194/203, 239, 194/244; 327/386

[56] References Cited

U.S. PATENT DOCUMENTS

| | | | |
|---|---|---|---|
| 3,665,208 | 5/1972 | Jachimek et al. | 327/384 X |
| 3,998,309 | 12/1976 | Mandas et al. | 194/203 |
| 4,028,560 | 6/1977 | Bainter | 327/386 |
| 4,903,282 | 2/1990 | Botker | 327/385 X |
| 4,926,998 | 5/1990 | Finegan | 194/316 X |

*Primary Examiner*—F. J. Bartuska

*Attorney, Agent, or Firm*—Jennifer M. Stec; Roger A. Johnston

[57] ABSTRACT

A coin acceptor mechanism (10) for recognizing the valid input of a coin (18) into a coin operated device wherein the mechanism (10) includes a sensor (28) which produces an electrical signal (30) indicative of the sensed presence or absence of a coin. A microprocessor (14) generates a periodic pulsed signal (46) and during a predetermined time period counts the number of pulses generated while the sensor output signal (30) indicates that a coin is present. Upon expiration of the predetermined time period, and once the sensor output signal (30) indicates the absence of a coin, pulses generated thereafter are counted. Once this count exceeds a predetermined value, a valid input is indicated if the first count also exceeded a predefined number.

14 Claims, 3 Drawing Sheets

FIG 1
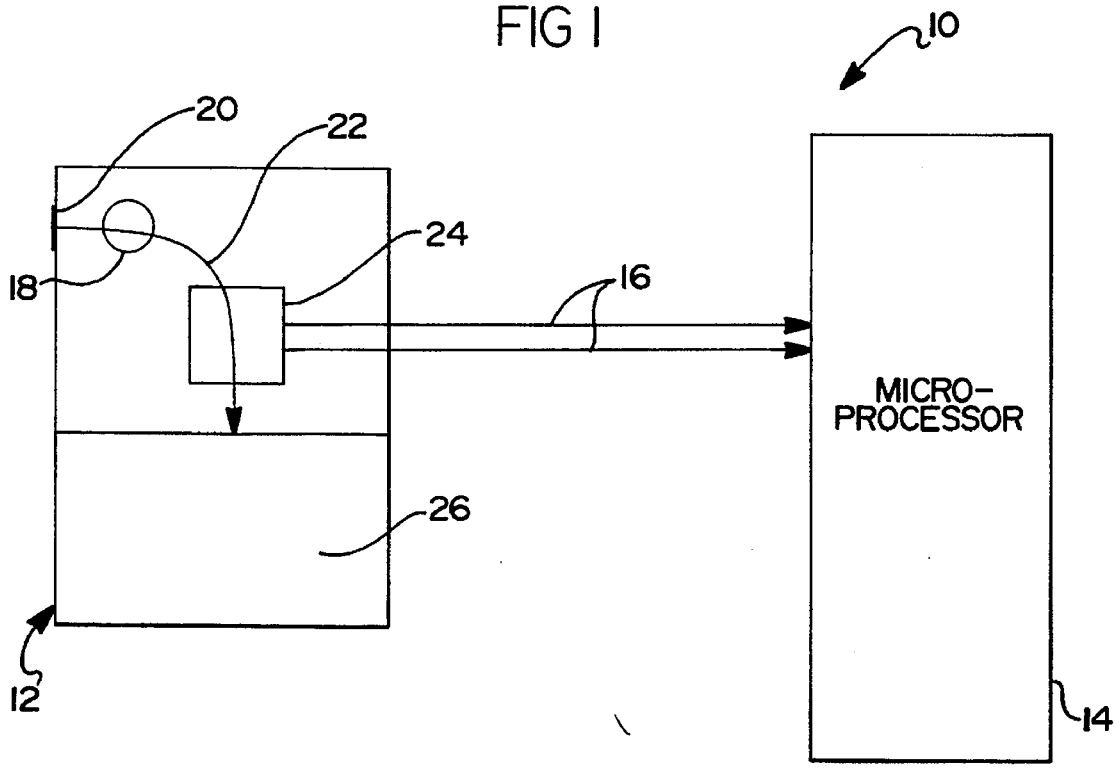
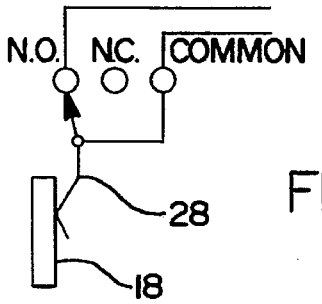
FIG 2

ELECTRICAL NOISE SUPPRESSION IN COIN ACCEPTOR MECHANISM

BACKGROUND AND SUMMARY OF THE INVENTION

This invention relates generally to coin operated devices and, more particularly, to an improved coin acceptor mechanism and a method of providing more accurate coin recognition by reducing the effects of electrical noise.

Coin acceptor mechanisms are commonly found in a vast array of devices including coin operated laundry machines, vending machines, pay telephones and video game or slot machines. These machines are typically operable only upon insertion of a predetermined designated amount of currency. In all such devices it is important to accurately recognize the input of proper coins or other tokens while automatically rejecting the input of slugs, pennies or other undesired objects. One common type of coin acceptor mechanism for accomplishing this task is illustrated schematically at 10 in FIG. 1. This type of device typically includes a mechanical coin acceptor 12 which is electrically connected to an electronic processor 14 via a set of leads or wires 16. A coin 18, or other token, is deposited into a designated slot 20 and is guided mechanically along a path 22. Coin path 22 is appropriately configured so as to guide coin 18 in a desired orientation through a coin read station 24, prior to deposit into a coin collection area 26, or otherwise rejection to a coin return (not shown).

The coin read station 24 may include a coin feeler spring/micro switch assembly 26 as shown in FIG. 2, or any other similar device which is capable of producing signals of two different conductive states. Switch 26 sends an electrical signal of one such conductive state over lines 16 to microprocessor 14 when in physical contact with a falling coin 18 and outputs at another state when not in contact with coin 18. In a like fashion, an optical reader such as a photo-interrupter or similar sensor device could alternately be used to provide the coin presence/absence signal over lines 16 whenever a coin or other object is detected/not detected at a given point.

Typically, microprocessor 14 is programmed with a methodology for analyzing the incoming electrical signal in order to assess when a valid coin has been deposited. To accomplish this, the microprocessor 14, upon first indication of coin presence, can check the signal on lines 16 a predetermined number of times for repeated indication of the presence of a coin. The number of instances checked is dependent upon factors such as the size of the coin and the speed at which it passes through the read station. In this example, there is a separate coin read station for each type of allowed coin input and each checks for only one type of coin but it will become readily apparent that the present invention is equally well adapted for use in other types of coin acceptor mechanisms as well.

However, as with any such device, real world conditions can cause the mechanism 10 to incorrectly accept an improper deposit or incorrectly reject a proper deposit. One common reason for this occurrence is a physical bouncing of the switch 26 as the coin 18 passes thereby. For instance, the force exerted by the falling coin on the mechanical spring can cause it to "bounce" thereby resulting in a situation wherein the signal on line 16 may be temporarily "interrupted" or wherein the sensor produces a signal of the incorrect conductive state. If the signal is interrupted at one or more points in time when microprocessor 14 is checking for the presence of a coin, the coin may be incorrectly rejected and returned. Rough surfaces on the coin, as well as various other conditions, may also cause the same problem.

The present invention provides an effective but simple solution to this problem which can be implemented inexpensively in microprocessor 14. As a coin passes into the read station, an "in slot" counter, preferably part of microprocessor 14, counts the number of two millisecond samples that are valid during a preset period of time. In other words, microprocessor 14 checks for two millisecond pulses occurring at the same time switch 26 outputs a signal of a particular conductive state, deemed indicative of coin presence. Any coincidence of a two millisecond pulse and an invalid coin present signal is ignored. At the end of a second predetermined time period, an "out of slot" counter, also preferably implemented as part of microprocessor 14, counts the number of samples coincident with an "out of slot" signal or a sensor 26 output signal at the other conductive state, that which is indicative of coin absence. In this manner, false rejections of valid coins are reduced. This results in a more accurate method of coin recognition which is less adversely affected by the electrical noise caused primarily by switch bounce.

These and other features and advantages of the present invention will become apparent upon review of the following disclosure, taken in conjunction with the accompanying drawings.

BRIEF DESCRIPTION OF THE DRAWINGS

FIG. 1 is a schematic view of a typical coin acceptor mechanism.

FIG. 2 is a schematic view of the coin read station shown in FIG. 1.

DETAILED DESCRIPTION OF THE PREFERRED EMBODIMENT

Figure 3:
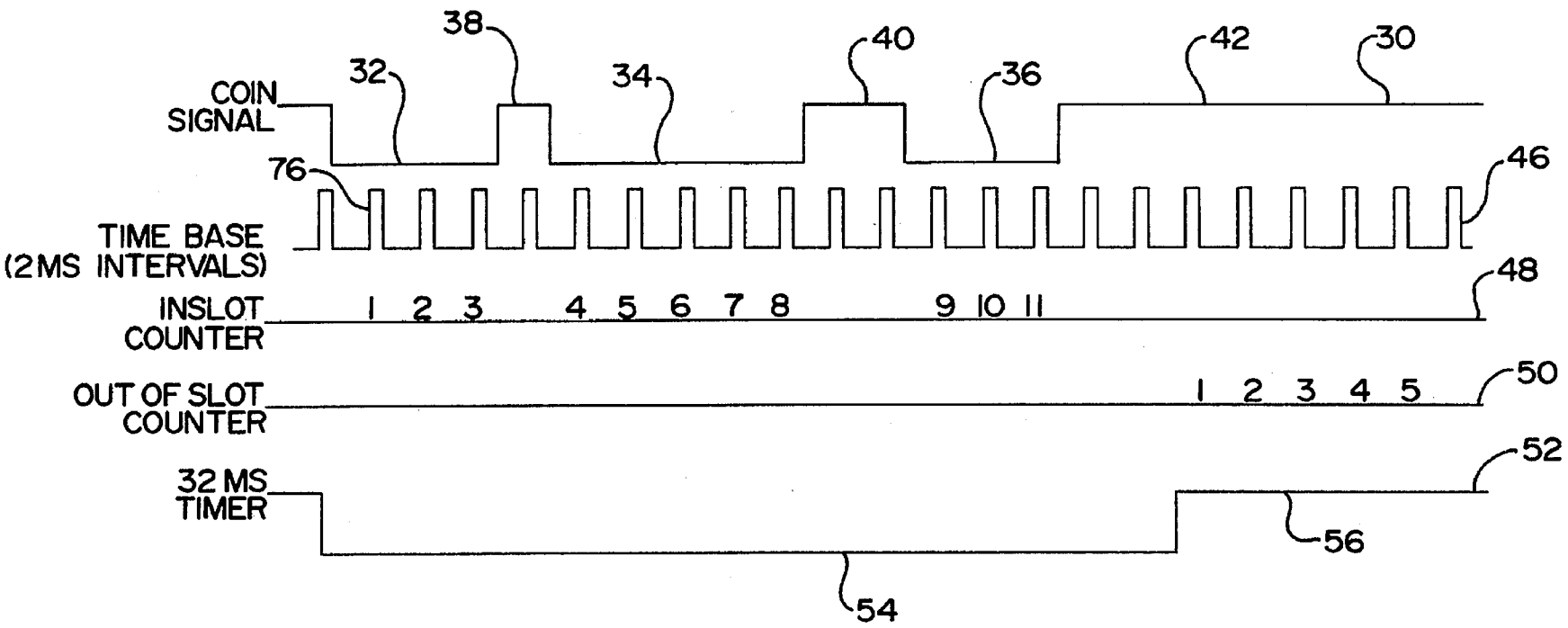
FIG. 3 is a signal timing diagram illustrating sample signals produced and analyzed by the coin acceptor mechanism according to the present invention.
Figure 4:
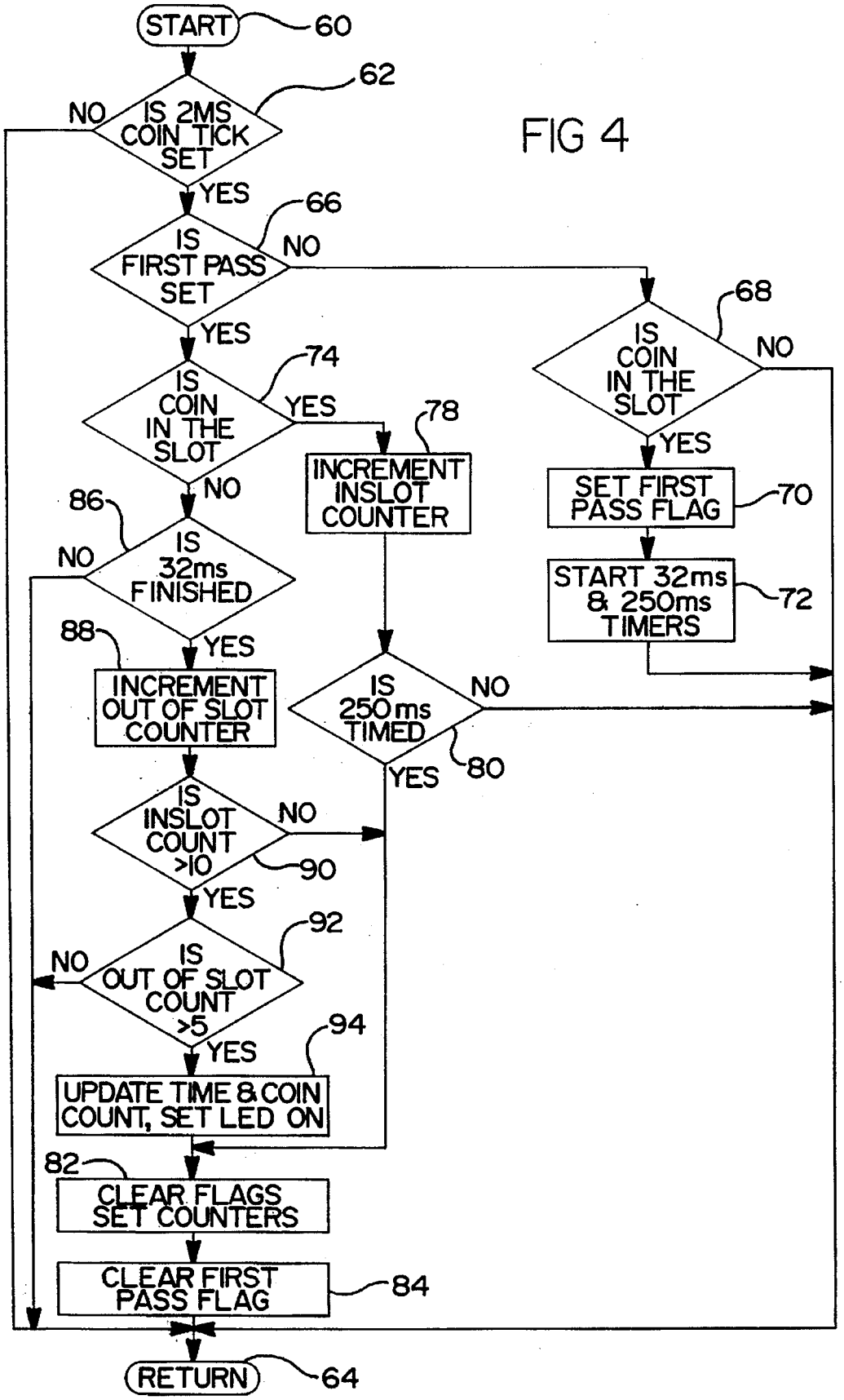
FIG. 4 is a flowchart illustrating the methodology by which the present invention determines whether a valid coin deposit has been made.

The improved electronic coin acceptor mechanism of the present invention and the operation thereof can be best understood with reference to FIGS. 3 and 4, taken together. The physical hardware for this acceptor may be like that illustrated in FIGS. 1 and 2. However, one of skill in the art will find it readily apparent that the present invention is equally well suited to coin acceptor mechanisms of various types and for use in almost any coin operated device. As shown in FIG. 3, a signal produced by a coin presence sensor, such as switch 26, and received by microprocessor 14 is indicated generally at 30. Signal 30 has a portion 32 at a first conductive state which is indicative of a period of time in which the presence of a coin is sensed, followed by a portion at a different conductive state which is indicative of a momentary absence of the coin or the occurrence of a "bounce" 38. Similarly, a coin is sensed at 34 and 36 and a second bounce occurs at 40. Portion 42 of signal 30 indicates that no coin is present, such as when coin 18 has moved all the way through read station 24 and into collection area 26.

A counter signal is provided at 46, this signal including a pulse created at two millisecond intervals. While two millisecond intervals are used in the present exemplary embodiment, it should become apparent that any other suitable time period could alternately be used. However, the selected time period should preferably be short enough such that a sufficient number of counts for the given coin size and amount of time it is in the coin read station is enabled, while coins that fail to produce the required number of counts because they are too small or fall too quickly are rejected. Comparing signal 30 with signal 46 results in a count made by an "in slot" counter, indicated at 48.

A similar "out of slot" count is generated at 50 by comparing pulsed signal 46 with coin absence indicting portions of signal 30 upon expiration of a longer timing signal set to be sufficient to allow the coin to have passed completely through the coin read station. In the present exemplary embodiment a thirty-two millisecond timing signal 52 is used but this time period also preferably varies with factors such as coin size.

The flowchart of FIG. 4 illustrates the method by which microprocessor 14 utilizes the signals in FIG. 3 to assess whether a valid coin deposit has been made. After starting at 60, a check is made on the two millisecond counter signal at decision block 62. If the pulsed signal has not been started, the routine returns at 64. If it has begun, the routine checks at decision block 66 to see whether a first pass flag has been set, this flag being indicative of the first pass having occurred.

If the first pass flag has not been set, control passes to decision block 68 which causes microprocessor 14 to check signal 30 for an indication that a coin is in read station 24. If no coin is present, control returns at 64. Once a coin is indicated to be present, the first pass flag is set at 70 and thirty-two millisecond and 250 millisecond timers are started at 72. As microprocessor 14 returns at 64 and begins again at 60, control passes through decision blocks 62 and 66 and through to decision block 74 which checks to ensure that the coin is still in the slot, via signal 30. If a coin is present, for instance when timing pulse 76 coincides with signal portion 32, the "in slot" counter is incremented at block 78.

If a 250 millisecond timer has not yet timed out at decision block 80, control returns at 64. This timer is designed to catch the proverbial "coin on a string" wherein someone may attempt to fool the coin reader by depositing a coin suspended on a string into the slot so as to have the same coin repeatedly counted and then removed so as to enable use of the coin operated machine for free. In the circumstance where this counter is timed out, the flags and counters are cleared at 82 and the first pass flag reset at 84.

The "in slot" counter continues to be incremented as long as signal 30 indicates that a coin is present in the reader. If a coin is not present, such as during a bounce 38, the thirty-two millisecond counter is checked at decision block 86. If the timer has not timed out, the loop repeats, simply ignoring the missed pulse (between the counts of three and four for bounce 38) until the timer has timed out. At that point, the "out of slot" counter is incremented at 88 and an "out of slot" count starts. If the "in slot" count is not greater than ten at decision block 90, thereby indicating that a coin was not counted by reader 24 or the occurrence of a lot of noise in signal 30, the flags and counters are cleared and the process begins again.

If the "in slot" count is greater than ten, an "out of slot" count greater than five is checked for in decision block 92. The counting process continues until an "out of slot" count of a predetermined amount, in this exemplary embodiment a count of five, is reached at which time the timer and coin counts are updated, a signal is sent to the device to indicate visually that a coin has been accepted and the flags and counters are all cleared at 82 and 84. Otherwise, if five counts are not achieved, a coin is not counted and the process begins again with a "first pass" when a coin presence signal is first indicated. Alternately, five consecutive counts could also be required.

While the count values of ten and five used in this exemplary embodiment provide a reliable coin validation system for a particular coin and a particular configuration of coin read station, counts of other values could also be used. The "in slot" count is preferably dependent upon various factors such as the size of a valid coin and the time it takes to pass through the coin read station. The "out of slot" count is preferably dependent upon factors such as a typical time period between coins passing through the coin read station. Ranges of values could also be used, such as for instance requiring from ten to fifty "in slot" counts. This would also cause rejection of a "coin on a string" without requiring the 250 millisecond timer since a suspended coin would result in a count that would be above the prescribed acceptable range.

Thus, the present invention ensures an adequate number of "in slot" counts while ignoring spurious "out of slot" counts, such as caused by a switch bounce. This enables a more accurate coin acceptance procedure than with previous coin acceptor mechanisms of this type. The foregoing discloses and describes merely an exemplary embodiment of the present invention. One having skill in the art will find it readily apparent that various changes and modifications can be made therein without departing from the spirit and scope of the invention as defined by the following claims.

What is claimed is:

1. A coin acceptor mechanism for recognizing the valid input of a coin into a coin operated device comprising:

a sensor adapted to provide an electrical output signal in response to the sensed presence or absence of an object in said coin acceptor mechanism;

a signal generator for generating a series of periodic electrical pulses;

a memory device for storing at least a first predetermined number and a second predetermined number;

a timer responsive to said sensor output signal adapted to be set upon a first indication of a coin presence indication provided by said sensor output signal, said timer adapted to produce a time out signal upon expiration of a fixed time period;

a first counter adapted to be incremented upon each incidence of each said generated pulse with a sensor output signal indicative of a sensed object presence occurring before said time out signal;

a second counter adapted to be incremented upon each incidence of each said generated pulse with a sensor output signal indicative of a sensed object absence occurring after said time out signal; and means for indicating a valid input when said first counter exceeds said first predetermined number and said second counter exceeds said second predetermined number.

2. The mechanism of claim 1 further including means for indicating an invalid input when said first counter does not exceed said first predetermined number or when said second counter does not exceed said second predetermined number.

3. The mechanism of claim 2 further comprising a second timer for producing a second time out signal upon expiration of a predefined time period greater than said fixed time period, said means for indicating an invalid input indicating such input upon occurrence of said time out signal by said second timer.

4. The mechanism of claim 3 further comprising means for resetting said timers and said counters upon indication of a valid or invalid input.

5. The mechanism of claim 1 wherein said object is a coin.

6. The mechanism of claim 1 wherein said first predetermined number is greater than 9 and said second predetermined number is greater than 4.

7. The mechanism of claim 1 wherein said second counter increments only in response to consecutive pulses occurring coincident with said object absence indicative sensor output signal.

8. The mechanism of claim 1 wherein said signal generator, memory, timer and counters are part of a microprocessor electrically coupled to said sensor.

9. The mechanism of claim 1 wherein said sensor includes a feeler spring.

10. The mechanism of claim 1 wherein said sensor indicates said presence by an electrical output signal at a first conductive state and said absence by an output signal at a second conductive state.

11. In a coin acceptor mechanism for a coin operated device, a method for recognizing the valid input of a coin and for rejecting an invalid input, said method comprising the steps of:

providing a sensor adapted to produce an electrical output signal indicative of the sensed presence or absence of an object in said acceptor mechanism;

providing a signal generator for generating a series of periodic electrical pulses;

upon a first indication of a sensed object presence on the sensed presence of said sensor output signal, starting a time period running;

while said time period is running, counting the number of pulses generated by said signal generator while said sensor output signal is indicative of the sensed presence of an object;

upon expiration of said time period, counting the number of pulses generated by said signal generator while said sensor output signal is indicative of the sensed absence of an object; and indicating a valid input when said first count exceeds a first predetermined number and said second count exceeds a second predetermined number.

12. The method of claim 11 further comprising the step of resetting said timer and said first and second counts upon indication of a valid or invalid input.

13. The method of claim 11 further comprising the step of starting a second timer upon said first indication of a sensed object presence, said second timer being adapted to run for a second time period greater than said first time period.

14. The method of claim 13 further comprising the step of indicating an invalid input if said second time period expires.

* * * * *